US012247556B2

(12) United States Patent
Groh et al.

(10) Patent No.: US 12,247,556 B2
(45) Date of Patent: Mar. 11, 2025

(54) PUMP DEVICE

(71) Applicant: HYDAC FLUIDTECHNIK GMBH, Saar (DE)

(72) Inventors: Christian Groh, Igersheim (DE); Frank Kattler, Püttlingen (DE)

(73) Assignee: HYDAC FLUIDTECHNIK GMBH, Sulzbach/Saar (DE)

( * ) Notice: Subject to any disclaimer, the term of this patent is extended or adjusted under 35 U.S.C. 154(b) by 327 days.

(21) Appl. No.: 17/840,111

(22) Filed: Jun. 14, 2022

(65) Prior Publication Data

US 2023/0400017 A1 Dec. 14, 2023

(51) Int. Cl.
*F04B 17/04* (2006.01)
*F04B 43/04* (2006.01)
(Continued)

(52) U.S. Cl.
CPC ..... *F04B 17/04* (2013.01); *F04B 17/042* (2013.01); *F04B 17/044* (2013.01);
(Continued)

(58) Field of Classification Search
CPC ..... F04B 17/04; F04B 17/042; F04B 17/044; F04B 17/046
See application file for complete search history.

(56) References Cited

U.S. PATENT DOCUMENTS 9,399,941 B2 7/2016 Groh et al.
2008/0115848 A1* 5/2008 Bruck ..... G05D 16/166 137/613
(Continued)

FOREIGN PATENT DOCUMENTS

DE 10 2008 046 060 4/2011
DE 10 2012 010 980 12/2013
(Continued)

OTHER PUBLICATIONS

Raw Machine Translation of DE102008046060; "• Reciprocating piston pump for conveying or dosing of hydraulic fluid, has pump piston which is guided in cylindrical element that is carried through drive in oscillating lifting movement, where pump chamber is limited in axial direction", Thomas Magnete (Year: 2010).*

*Primary Examiner* — Charles G Freay
*Assistant Examiner* — Lilya Pekarskaya
(74) *Attorney, Agent, or Firm* — Wenderoth, Lind & Ponack, L.L.P.

(57) ABSTRACT

A pump device having a pump piston (12) longitudinally movable in a pump housing (10), which pump piston is actuated by an actuating solenoid (14) to open an outlet valve (16) for discharging a fluid during a delivery stroke. In a pump space (18) of the pump housing (10), during a suction stroke, the pump piston (12) generates a negative pressure and, upon passing over a control edge (20) delimiting the pump space (18), the piston establishes a fluid connection between a fluid inlet (22) in the pump housing (10) and the pump space (18). The pump space (18), under the negative pressure in the pump space (18), is filled resulting from a fluid flow along the outer circumference (24) of parts of the pump piston (12) toward the outlet valve (16). During the delivery stroke, this filling volume is discharged from the pump space (18) via the outlet valve (16).

18 Claims, 2 Drawing Sheets

(51) Int. Cl.
*F04B 53/12* (2006.01)
*F04B 53/14* (2006.01)

(52) U.S. Cl.
CPC ..... *F04B 17/046* (2013.01); *F04B 43/04* (2013.01); *F04B 53/125* (2013.01); *F04B 53/14* (2013.01)

(56) References Cited

U.S. PATENT DOCUMENTS

| | | | | |
|---|---|---|---|---|
| 2015/0159530 | A1 | 6/2015 | Groh et al. | |
| 2015/0260172 | A1* | 9/2015 | Ishikawa | F04B 17/03 417/415 |
| 2016/0281695 | A1* | 9/2016 | Toennesmann | F04B 17/044 |
| 2018/0283332 | A1* | 10/2018 | Nong | F02M 69/02 |
| 2019/0003474 | A1* | 1/2019 | Fochtman | F04B 53/109 |
| 2019/0145393 | A1* | 5/2019 | Gibson | F04B 49/065 417/44.1 |
| 2021/0016754 | A1* | 1/2021 | Keyl | F04B 53/121 |

FOREIGN PATENT DOCUMENTS

| | | |
|---|---|---|
| DE | 10 2018 001 523 | 8/2019 |
| DE | 10 2019 000 488 | 7/2020 |
| WO | 2017/148841 | 9/2017 |

* cited by examiner

PUMP DEVICE

FIELD OF THE INVENTION

The invention relates to a pump device having a pump piston arranged in a longitudinally movable manner in a pump housing, which pump piston is actuated by an actuating solenoid device to open an outlet valve for discharging a fluid during a delivery stroke.

BACKGROUND OF THE INVENTION

DE 10 2018 001 523 A1 discloses a device for providing fluids at a predetermined pressure for the pressure supply of a delivery module, such as a work unit of an SCR (Selective Catalytic Reduction) system for the exhaust gas treatment of internal combustion engines, having at least one pump device, which, in a fluid circuit formed between a fluid supply and a consumer, takes the relevant fluid from the fluid supply and supplies it to the consumer. For its operation the known pump device requires a conventional pressure supply in the form of a driven hydro pump. The advantage of this known pump device is that during periods of standstill under freezing conditions there is no or little freezable fluid, regularly as an aqueous urea solution (Adblue), in the pump, which could freeze and then damage parts of the pump device until they become unusable. A comparable device for providing a fluid at a predetermined pressure is shown in DE 10 2019 000 488 A1, wherein again a driven hydro pump is used to supply the pump delivery device for its operation.

DE 10 2012 010 980 A1 discloses a system for the exhaust gas treatment of an internal combustion engine, having a pump device with a pump piston arranged in a longitudinally movable manner in a pump housing, which, controlled by an actuating solenoid device, acts both on an inlet valve and on an outlet valve, wherein the inlet valve opens on the intake stroke of the pump piston and the outlet valve opens on its delivery stroke. The known solution is used for a metered supply of a freezable substance, in particular an aqueous urea solution. A compensating device is used as protection against damage to the system due to volume expansion when the substance freezes, which compensating device acts on a fluid or a pump space in such a way that volume expansion of the substance within this fluid or pump space associated with an increase in fluid pressure during freezing is compensated.

Although all the systems mentioned above with appropriately designed pumping device are preferably used in the context of aqueous urea solutions (Adblue), they are also basically suitable for transporting or conveying all kinds of fluid media, including hydraulic oils and specifically designed transmission oils. In any case, it is characteristic that at very high cycle rates, the known systems and their respective pumping devices can always only transport small quantities or volumes of fluid.

SUMMARY OF THE INVENTION

Based on this state of the art, the invention addresses the problem of providing a further alternative to the known systems and pump devices, while retaining their advantages, which alternative is characterized by a high degree of functional reliability and which can be implemented in a space-saving and cost-effective manner.

A pump device that solves this problem has a pump piston that generates a negative pressure in a pump space of the pump housing during a suction stroke. Upon passing over a control edge delimiting the pump space, the piston establishes a fluid connection between a fluid inlet in the pump housing and the pump space in such a way that the pump space under the effect of the negative pressure present therein is filled with a filling volume, which results from a fluid flow routed along the outer circumference of parts of the pump piston in the direction of the outlet valve. Subsequently, during the delivery stroke, this filling volume is discharged from the pump space via the outlet valve. A delivery device for fluid is created, which does not require a separate inlet valve, just the outlet valve.

Instead, the pump space in the pump housing is filled with fluid exclusively via the control motion of the pump piston, which fluid is discharged by means of the pump piston via the outlet valve in the subsequent delivery stroke. As the suction stroke increases, the vacuum in the pump space first increases until the pump piston moves backwards in the direction of the fluid supply beyond the control edge at the pump housing, abruptly releasing a fluid connection between the fluid supply and the pump space. The fluid then flows from the inlet into the pump space through the annular gap formed in this way at high flow velocity. The fluid flowing past the outer circumference of parts of the pump piston into the pump space when the control edge is released is discharged in a positively controlled manner as a filling volume in the subsequent forward delivery stroke by the pump piston via the outlet valve opening then.

Because there is no additional inlet valve, typically as a spring-loaded check valve that has to be controlled by the pump device or its fluid flow during the suction stroke, the stroke or load changes from suction stroke to delivery stroke can be performed in rapid succession, resulting in very high cycle rates in the smallest installation space for the pump device according to the invention. The omission of an inlet valve thus reduces the number of components by one, which is cost-effective, and one fewer movable valve component that could possibly fail, increasing the overall functional reliability.

In a preferred embodiment of the pump device according to the invention, provision is made for the outlet valve to be a spring-loaded check valve whose valve piston, in the closed state, shuts off the pump space relative to a fluid outlet, wherein the valve piston and the pump piston are coaxial. During the delivery stroke of the pump piston, the force to open the valve piston of the check valve is applied in the same direction as the axis of travel of the pump piston, so that for a centered application of force to the valve piston the outlet valve can be directly actuated. In this way, obstructions in the operation of the outlet valve are precluded.

In a further preferred embodiment of the pump device according to the invention, provision is made for the pump piston to move the valve piston of the check valve to its open position during the delivery stroke owing to the fluid volume displaced in this way. At a maximum delivery stroke, the volume of fluid forced out of the pump space by the pump piston results in the complete opening of the check valve, providing for a pure fluid actuation of the check valve by the pump piston, which permits an operation without obstruction.

In a particularly preferred embodiment of the pump device according to the invention, provision is made for the diameter of pump piston to be reduced in the direction of its free end face facing the valve piston compared to its diameter in the area of the guide of the pump piston in the pump housing. Preferably, provision is also made for the pump piston, starting from its guide diameter in the pump housing, to have a recess in the form of a diameter reduction merging into a truncated cone as a flow guide device, which is adjoined by a further diameter reduction of the pump piston in the form of a control cylinder. In particular, the recess and the flow guide device, both as integral parts of the pump piston, result in optimum fluid guidance with corresponding entry of the filling volume into the pump space, wherein the recess on the pump piston contributes to the vacuum generated in the pump space by the pump piston being stopped rather abruptly and the inflow of the fluid from the fluid supply into the pump space for the subsequent discharge process can occur within one delivery stroke.

If preferably, provision is made for the pump space to have various chambers, which are provided with different diameters and of which a central chamber has at least partially such a diameter that an annular gap is formed between the pump housing and the outer wall of the pump piston with its outer diameter in the area of its guidance in the pump housing, that is a further contributing factor. In particular, the aforementioned annular gap ensures the unobstructed operation during the suction stroke and the immediate buildup of a corresponding vacuum in the pump space, especially in the chamber of the pump space having the largest cross-section.

In a further preferred embodiment of the pump device according to the invention, provision is made for an annular seal attached to the end face of the pump housing to adjoin a valve housing, in which the check valve is accommodated. Provision is further made for the valve housing to comprise part of the fluid inlet and for the valve housing to accommodate the pump housing.

Further, provision is advantageously made for the actuating solenoid device to be connected to the valve housing, which is attached in conjunction with the pump housing in the manner of a screw-in cartridge in a valve block comprising parts of the fluid inlet and outlet. In this way, a kind of modular system is implemented wherein the main components are the pump housing with pump piston, the valve housing and the actuating solenoid device. The main components, which can be screwed together, can be easily adapted in size depending on the fluid volume to be controlled and assembled to form an overall pumping device in a cost-effective manner.

In a further preferred embodiment, provision is made for the pump piston to perform a delivery stroke when the actuating magnet device is actuated and for the pump piston to perform a suction stroke in the opposite direction by means of an energy storage, preferably in the form of a compression spring, when the actuating magnet device is not actuated. Consequently, it is only necessary to energize the actuating solenoid device for the delivery stroke, and when it is not actuated, the pump piston is automatically moved to a rearward starting position corresponding to the suction stroke by an energy storage, resulting in an extremely energy-saving operation of the pump device.

BRIEF DESCRIPTION OF THE DRAWINGS

Below, the pump device according to the invention is explained in more detail based on an exemplary embodiment according to the drawing. In the figures, in general view, not to scale.

DETAILED DESCRIPTION OF THE INVENTION

Figure 1:
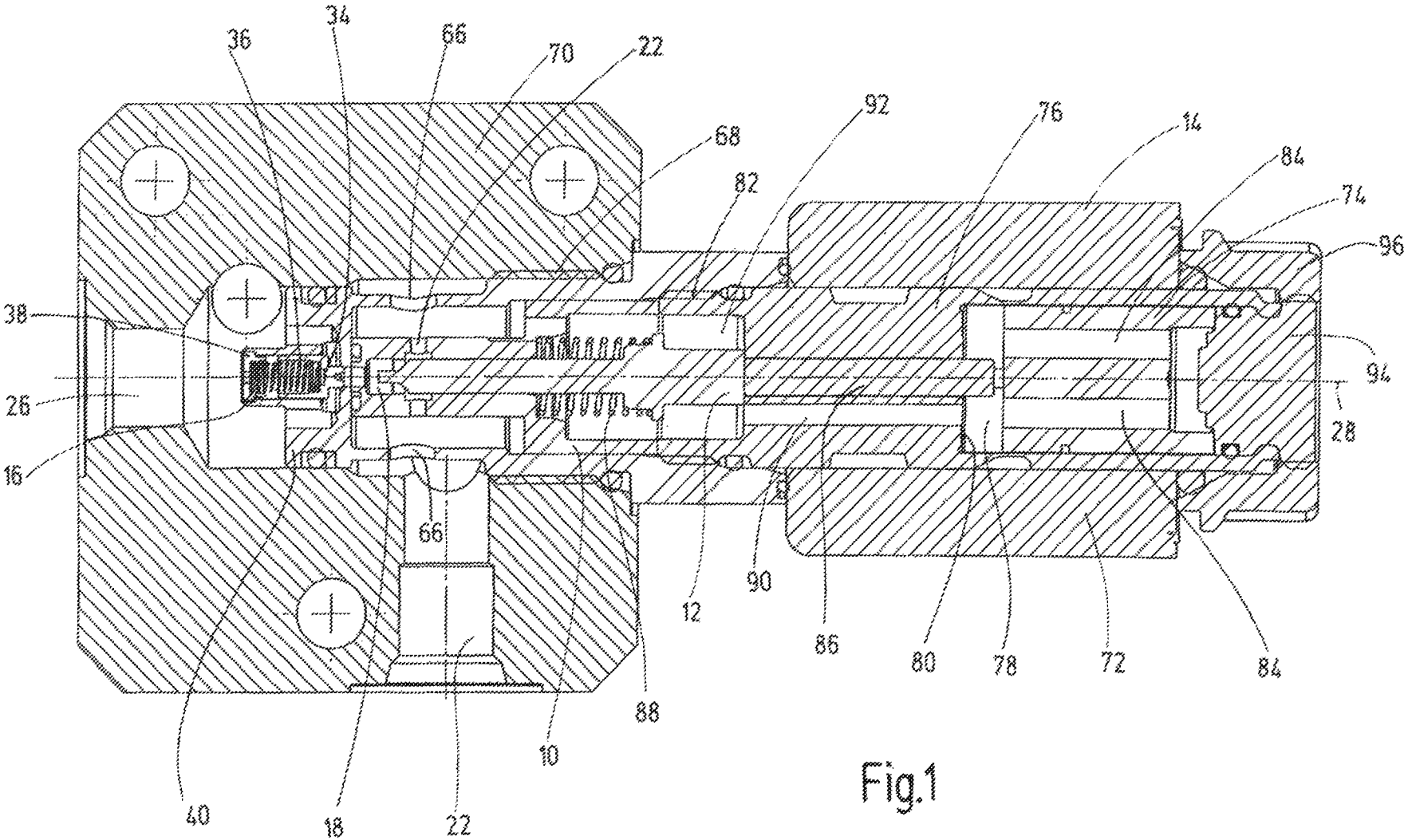
FIG. 1 shows a longitudinal sectional view of the pump device as a whole.

The pump device according to FIG. 1 has a pump piston 12 arranged in a longitudinally movable manner in a pump housing 10, which pump piston 12, controlled by an actuating solenoid device 14, controls an outlet valve 16 to open for delivering fluid by means of fluid pressure during a delivery stroke from the right to the left as viewed in the direction of FIG. 1. When the pump piston 12 moves in the opposite direction from the left to the right from a forward position to a rearward position, as viewed in the direction of FIG. 1, it generates a negative pressure in a pump space 18 of the pump housing 10 during this suction stroke. If the pump piston 12 then passes over an annular control edge 20 of the pump housing 10 during its return motion, wherein said control edge 20 limits the pump space 18 in the direction of a fluid inlet 22 in the pump housing 10, a fluid connection is established between this fluid inlet 22 in the pump housing 10 and the pump space 18. This fluid connection is established abruptly and, due to the negative pressure in the pump space 18, fluid flows from the inlet 22 into the pump space 18 at a high flow velocity, thus continuously increasing its filling volume. If the pump space 18 under the effect of the negative pressure present therein is filled with the filling volume, which results from a fluid flow routed along the outer circumference 24 from front-end parts of the pump piston 12 towards the outlet valve 16, for further use this filling volume during the subsequent delivery stroke of the pump piston 12 displaced at the front end, can be discharged from the pump device via a fluid outlet 26 when the outlet valve 16 is open.

The fluid inlet 22 consists of a plurality of drilled holes 30 arranged diametrically with respect to a longitudinal axis 28 of the pump device, wherein the drilled holes 30 extend transverse with respect to the longitudinal axis 28 and radially through the pump housing 10 at the same elevation. The inner, free end of every drilled hole 30 opens into a circumferential radial recess 32 through which the pump piston 12 can pass and the outer diameter of which at every location being greater than the diameter of the pump space 18 at every location. The annular control edge 20, which is formed in a continuously circumferential manner, is thus formed by a transition rim or edge, namely at the point of transition of the pump space 18 into the radial recess 32.

As FIG. 1 further shows, the outlet valve 16 is formed by a spring-loaded check valve, whose valve piston 34, as shown in Figures land 2, closes off the pump space 18 from the fluid outlet 26 when in the closed position and apart from that is arranged to extend coaxially with the pump piston 12. The valve piston 34 is cup-shaped and accommodates parts of a return spring 36 designed as a compression spring in its cup space, one free end of which return spring is supported on the valve piston 34 and its other end is supported in a housing mount 38 closed at the bottom, wherein said housing mount 38 is preferably an integral part of a valve housing 40. When the valve piston 34 is controlled to open against the action of the return spring 36, a sealing pin 42 located on the free end face of the valve piston 34 releases an annular valve seat 44 on the valve housing 40 and fluid can be discharged from the pump space 18 past the valve seat 44 in the direction of the fluid outlet 26 out of the pump device. For this push-out process, a delivery stroke of the pump piston 12 is required, during which the piston, after passing over the control edge 20, pushes the fluid in the pump space 18 forward and in doing so moves the spring-loaded valve piston 34 to its opening position away from the valve seat 44. If the fluid pressure drops after the fluid volume has been discharged from the pump space 18, the valve piston 34 can return to its shown closed position and the pump piston 12 moves backwards, generating a corresponding vacuum in the pump space 18, until the pump piston 12 again passes backwards the control edge 20 for a new fluid filling process and takes, for instance, its rearward position shown in FIGS. 1 and 2.

The valve seat 44 is formed as an annular abutment surface disposed in the valve housing 40, which annular abutment surface also makes for some kind of line contact between the sealing pin 42 and adjacent parts of the valve housing 40. As can also be seen in FIG. 2, the diameter of the pump piston 12 is reduced in the direction of its free end face facing the valve piston 34 compared to its diameter in the area of the guide 46 of the rod-like pump piston 12 in the pump housing 10. A recess 48 in the form of a diameter reduction merges seamlessly into a truncated cone 50 as a flow-directing device, which is adjoined by a further diameter reduction of the pump piston 12 having the shape of an elongated control cylinder 52. The recess 48 forms a rectangular control edge that interacts correspondingly with the control edge 20 on the pump housing 10 to control the flow of fluid. The angle of the control cone in the form of the truncated cone 50, as viewed in the direction of the longitudinal axis 28, is approximately 45°, and the truncated cone, both at its base surface and at its top surface, transitions with a corresponding arc of roundness into the step-shaped recess 48 and into the control cylinder 52, respectively, the free cross-sectional area of which is smaller than the free cross-sectional area of the pump space 18 in the area of the transition to housing parts of the valve housing 10 in the area of the valve seat 44.

Figure 2:
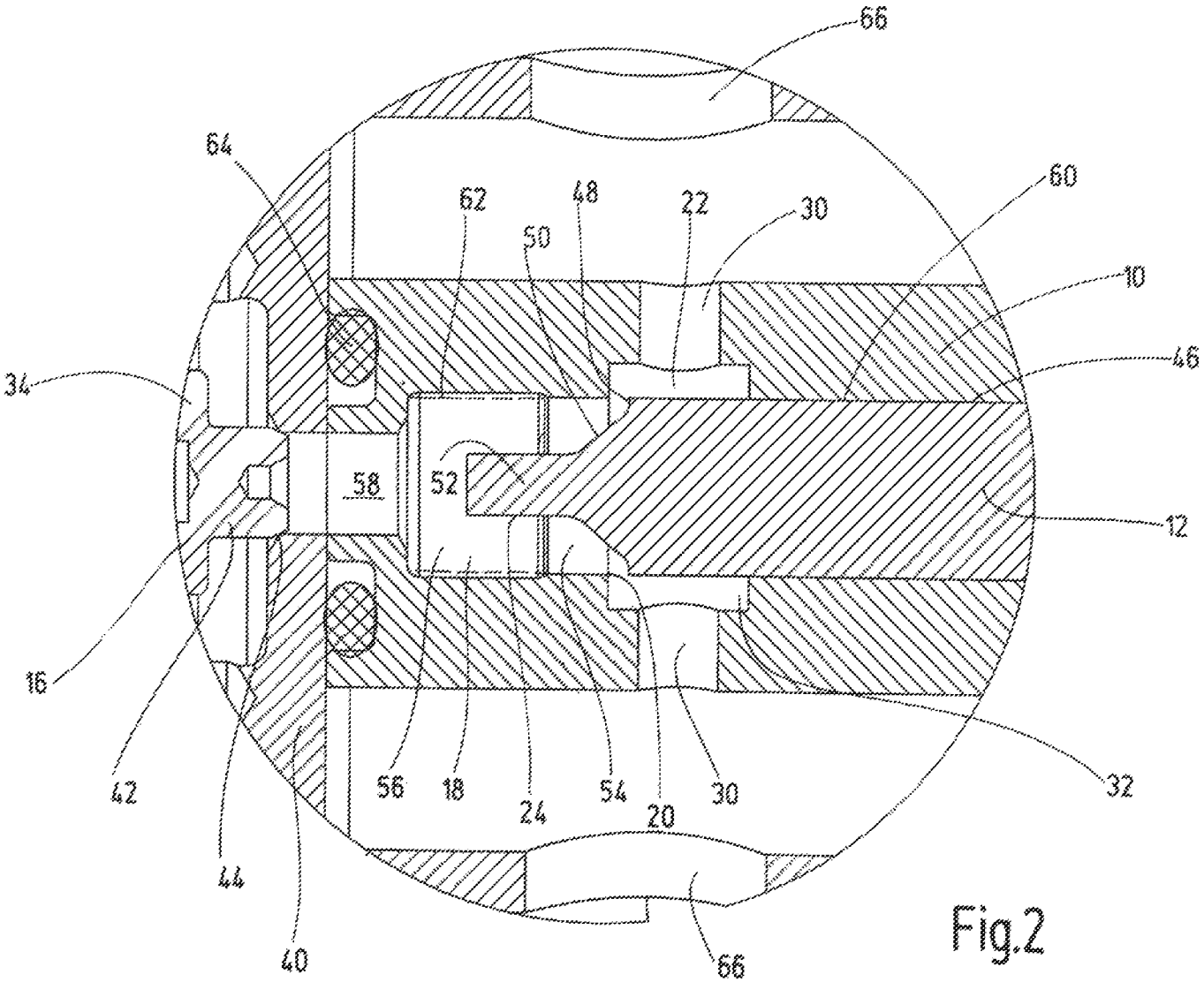
FIG. 2 shows a section of the illustration according to FIG. 1 including an end-face area of a pump piston together with the pump space and parts of an outlet valve.

The pump space 18 has various chambers 54, 56 and 58, which are provided with different diameters and of which a central chamber 56 has at least in part a diameter such that an annular gap 62 is formed between the pump housing 10 and the outer diameter of the outer wall 60 of the pump piston 12 in the area of the guide in the pump housing 10, which annular gap in FIG. 2 is depicted using a dashed line in a fictitious manner to represent the distance between the pump piston 12 and the pump housing 10, provided that the pump piston 12 takes one of its forward travel positions in this respect.

As shown in particular in FIG. 2, an end-face mounted annular seal 64 of the pump housing 10 is connected to the valve housing 40, which receives the outlet valve 16 centrally as viewed in the direction of the fluid outlet 26. In particular, as further shown in FIG. 1, the valve housing 40 comprises a part of the fluid inlet 22. For this purpose, further through holes 66 arranged diametrically to the longitudinal axis 28, are arranged in the valve housing 40, which through holes 66 are arranged at the same elevation as the holes 30 in the pump housing 10; however, in contrast, they have a larger diameter. The valve housing 40 is formed like a screw-in cartridge and is accommodated in a central cuboid valve block 70 having a fluid inlet 22 transverse to the longitudinal axis 28 and a fluid outlet 26 along the longitudinal axis 28 by a screw-in section 68. In this way, the radial recess 32 in the pump housing 10 is permanently connected to the fluid inlet 22 in the valve block 70 in a fluid-conveying manner via the drilled holes 30 and 66.

The pump piston 12 is actuated by the actuating solenoid device 14, which is of conventional design and has a solenoid armature 74 actuated by an energizable coil 72 and guided for longitudinal motion in a pole tube 76, specifically in an armature chamber 78, which has a so-called anti-adhesion disc 80 on its one free end face as viewed in the direction of the pump piston 12. The pole tube 76 is secured to the valve housing 40 by assigned wall parts via a further screw-in section 82. Further, in the attached state, the free end face of the pole tube 76 presses the pump housing 10 against the associated abutment wall of the valve housing 40 via the flexible annular seal 64. Longitudinal channels 84 disposed in the solenoid armature 74 provide pressure-balanced operation for the solenoid armature 74 from its right-hand stop position shown in FIG. 1, to its anterior actuation position which is anterior in the direction of the anti-adhesion disc 80, and vice versa.

During actuation, i.e. when the coil 72 is energized, the solenoid armature 74 entrains a rod part 86, which in turn entrains the pump piston 12 for one delivery stroke from its right-hand, rearward position shown in FIG. 1 to the left into an anterior actuation position. When the actuating solenoid 14 is de-energized, the pump piston 12 is moved to its maximum suction stroke position under the action of an energy storage in the form of the compression spring 88, wherein the rod 86 is returned, entraining the solenoid armature 74 to its starting position shown in FIG. 1. For this purpose, one free end of the compression spring 88 is supported at a free end face of the pump housing 10 and its other free end at a contact widening on the pump piston 12. For operation without obstruction, the pole tube 76 has a through passage 90, which connects the armature chamber 78 to a piston chamber 92 in a media-conveying manner, which as part of the pump housing 10 accommodates parts of the pump piston 12 together with the compression spring 88.

The pump piston 12 can be actuated in temporarily close succession by controlling the actuating magnet of the solenoid device 14, to ensure a quasi-continuous pump operation at the location of the fluid discharge 26 in the valve block 70, wherein, in view of the small volume of the pump space 18, only a small amount of volume is discharged at any one time. Towards the outside, the magnet device 14 is closed by an end plug 94, which is flanged to the right free end face of the pole tube 76. A screw-on nut 96 covers the connection between the end plug 94 and the pole tube 76 towards the outside.

The pump piston 12 opens the valve piston 34 of the check valve preferably exclusively by applying a corresponding fluid pressure, wherein the pin-like control cylinder 52 is used to minimize the dead volume in this area, resulting in a better efficiency of the actuation. However, it is still within the scope of the solution according to the invention to use the control pin 52 also for a mechanical opening operation of the valve piston 34 when required.

What is claimed is:

1. A pump device, comprising:

a pump housing having a pump space therein;

a pump piston longitudinally movable in the pump housing, the pump piston being connected to and actuated by an actuating solenoid;

an outlet valve in the pump housing being openable by the pump piston for discharging a fluid during a delivery stroke;

in the pump space of the pump housing, during a suction stroke, the pump piston being capable of generating a negative pressure and, upon passing over a control edge of the pump housing delimiting the pump space, the pump piston being capable of establishing a fluid connection between a fluid inlet in the pump housing and the pump space allowing the pump space under an effect of the negative pressure present in the pump space and filling the pump space with a filling volume of the fluid resulting from a fluid flow routed along an outer circumference of parts of the pump piston in a direction of the outlet valve, and subsequently, during the delivery stroke, the filling volume being discharged from the pump space via the outlet valve;

an annular seal attached to an end face of the pump housing; and a valve housing being adjoined to the pump housing by the annular seal, and further being a part of the fluid inlet and receiving the outlet valve.

2. The pump device according to claim 1, wherein the outlet valve comprises a spring-loaded check valve with a valve piston that shuts off the pump space relative to a fluid outlet in a closed state of the valve piston, the valve piston and the pump piston being coaxial.

3. The pump device according to claim 2, wherein the pump piston moves the valve piston of the check valve into an open position thereof during the delivery stroke owing to the filling volume discharged by the pump piston.

4. The pump device according to claim 1, wherein a transverse diameter of pump piston is reduced in a direction of a free end face of the pump piston facing the valve piston compared to a diameter of the pump piston in an area of a guide of the pump piston in the pump housing.

5. The pump device according to claim 4, wherein the pump piston, starting from the guide in the pump housing, has a recess in a form of a diameter reduction merging into a truncated cone as a flow guide adjoined by a further diameter reduction of the pump piston in a form of a control cylinder.

6. The pump device according to claim 1, wherein the pump space has various chambers provided with different diameters, the various chambers including a central chamber having at least partially a diameter forming an annular gap between the pump housing and an outer wall of the pump piston with an outer diameter of the pump piston in an area of a guide of the pump piston in the pump housing.

7. The pump device according to claim 1, wherein the valve housing accommodates the pump housing.

8. The pump device according to claim 1, wherein an actuating solenoid is connected to the valve housing and is attached in conjunction with the pump housing as a screw-in cartridge in a valve block having parts of the fluid inlet and outlet.

9. The pump device according to claim 1, wherein the pump piston performs the delivery stroke when an actuating magnet device is actuated; and the pump piston performs the suction stroke in an opposite direction from the delivery stroke by an energy storage when the actuating magnet device is not actuated.

10. The pump device according to claim 9, wherein the energy storage is a compression spring.

11. A pump device, comprising:

a pump housing having a pump space therein;

a pump piston longitudinally movable in the pump housing, the pump piston being connected to and actuated by an actuating solenoid;

an outlet valve in the pump housing being openable by the pump piston for discharging a fluid during a delivery stroke;

in the pump space of the pump housing, during a suction stroke, the pump piston being capable of generating a negative pressure and, upon passing over a control edge of the pump housing delimiting the pump space, the pump piston being capable of establishing a fluid connection between a fluid inlet in the pump housing and the pump space allowing the pump space under an effect of the negative pressure present in the pump space and filling the pump space with a filling volume of the fluid resulting from a fluid flow routed along an outer circumference of parts of the pump piston in a direction of the outlet valve, and subsequently, during the delivery stroke, the filling volume being discharged from the pump space via the outlet valve; and the pump space having various chambers provided with different diameters, the various chambers including a central chamber having at least partially a diameter that is forming an annular gap between the pump housing and an outer wall of the pump piston with an outer diameter of the pump piston in an area of a guide of the pump piston in the pump housing.

12. The pump device according to claim 11, wherein the outlet valve comprises a spring-loaded check valve with a valve piston that shuts off the pump space relative to a fluid outlet in a closed state of the valve piston, the valve piston and the pump piston being coaxial.

13. The pump device according to claim 12, wherein the pump piston moves the valve piston of the check valve into an open position thereof during the delivery stroke owing to the filling volume discharged by the pump piston.

14. The pump device according to claim 11, wherein a transverse diameter of pump piston is reduced in a direction of a free end face of the pump piston facing the valve piston compared to a diameter of the pump piston in an area of a guide of the pump piston in the pump housing.

15. The pump device according to claim 14, wherein the pump piston, starting from the guide in the pump housing, has a recess in a form of a diameter reduction merging into a truncated cone as a flow guide adjoined by a further diameter reduction of the pump piston in a form of a control cylinder.

16. The pump device according to claim 11, wherein an actuating solenoid is connected to the valve housing and is attached in conjunction with the pump housing as a screw-in cartridge in a valve block having parts of the fluid inlet and outlet.

17. The pump device according to claim 11, wherein the pump piston performs the delivery stroke when an actuating magnet device is actuated; and the pump piston performs the suction stroke in an opposite direction from the delivery stroke by an energy storage when the actuating magnet device is not actuated.

18. The pump device according to claim 17, wherein the energy storage is a compression spring.

* * * * *